US010781537B2

(12) United States Patent
Morgner

(10) Patent No.: US 10,781,537 B2
(45) Date of Patent: Sep. 22, 2020

(54) FIBER CONVEYOR AND FIBER BLENDING UNIT

(71) Applicant: TEMAFA MASCHINENFABRIK GMBH, Bergisch Gladbach (DE)

(72) Inventor: Joerg Morgner, Kuerten (DE)

(73) Assignee: TEMAFA Maschinenfabrik GmbH, Bergisch Gladbach (DE)

( * ) Notice: Subject to any disclaimer, the term of this patent is extended or adjusted under 35 U.S.C. 154(b) by 74 days.

(21) Appl. No.: 15/978,590

(22) Filed: May 14, 2018

(65) Prior Publication Data

US 2018/0334762 A1 Nov. 22, 2018

(30) Foreign Application Priority Data

May 15, 2017 (DE) ..... 10 2017 110 550
Jul. 6, 2017 (DE) ..... 10 2017 115 161

(51) Int. Cl.
*D01G 13/00* (2006.01)
*D01G 23/00* (2006.01)

(52) U.S. Cl.
CPC ..... *D01G 13/00* (2013.01); *D01G 23/00* (2013.01)

(58) Field of Classification Search
CPC ..... D01G 7/06; D01G 13/00; D01G 23/00; D01G 23/02; D01G 23/04
See application file for complete search history.

(56) References Cited

U.S. PATENT DOCUMENTS 1,729,341 A * 9/1929 Johnson ..... A01F 25/186 406/162
2,187,330 A * 1/1940 Rudd ..... D21C 7/06 414/586
2,208,788 A * 7/1940 Courtney ..... B65G 53/528 406/155
3,521,998 A * 7/1970 Janousek ..... D01G 29/00 8/149.2
3,908,818 A * 9/1975 Selby ..... D01G 23/00 198/622
3,963,111 A * 6/1976 Harrell ..... B65G 43/08 19/48 R
4,175,893 A 11/1979 Leifeld et al.
4,531,262 A 7/1985 Reiche
(Continued)

FOREIGN PATENT DOCUMENTS

DE 330 799 C 12/1920
DE 12 92 050 B 4/1969
(Continued)

OTHER PUBLICATIONS

German Patent Office Search Report, dated Apr. 11, 2018.
EPO Search Report, dated Sep. 19, 2018.

*Primary Examiner* — Shaun R Hurley
(74) *Attorney, Agent, or Firm* — Dority & Manning, P.A.

(57) ABSTRACT

A fiber conveyor for a fiber blending unit includes a blending belt, wherein fiber material dropped onto the blending belt from a bale opener is transportable away by the blending belt. Opposite guide walls are arranged laterally to the blending belt to guide the fiber material on both sides of the blending belt. A rotary distributor is arranged above the blending belt so that the fiber material dropped onto the blending belt is distributable in a transverse direction of the blending belt between the two guide walls by rotational movement of the rotary distributor.

8 Claims, 3 Drawing Sheets

(56) References Cited

U.S. PATENT DOCUMENTS

| | | | | | |
|---|---|---|---|---|---|
| 4,769,873 | A * | 9/1988 | Pinto | D01G 23/02 | 19/105 |
| 4,968,188 | A * | 11/1990 | Lucassen | D01G 23/02 | 19/105 |
| 5,257,438 | A * | 11/1993 | Faas | D01G 23/04 | 19/105 |
| 5,382,609 | A * | 1/1995 | Lock | D04H 1/425 | 156/283 |
| 5,628,090 | A * | 5/1997 | Lock | D04H 1/425 | 19/296 |
| 6,101,679 | A * | 8/2000 | Freund | D01G 23/02 | 19/205 |
| 6,235,999 | B1 * | 5/2001 | Rubenach | D01G 23/045 | 177/116 |
| 8,162,243 | B2 * | 4/2012 | Wenthe | B02C 4/286 | 241/159 |
| 2002/0108216 | A1 * | 8/2002 | Foster | D01G 13/00 | 19/145.5 |
| 2006/0067161 | A1 | 3/2006 | Rubenach | | |

FOREIGN PATENT DOCUMENTS

| | | | |
|---|---|---|---|
| DE | 31 51 063 | A1 | 7/1983 |
| DE | 41 30 822 | A1 | 3/1993 |
| DE | 100 41 838 | A1 | 4/2001 |
| DE | 10 2004 048 222 | A1 | 4/2006 |
| EP | 0 063 283 | A1 | 10/1982 |

* cited by examiner

FIBER CONVEYOR AND FIBER BLENDING UNIT

FIELD OF THE INVENTION

The present invention relates to a fiber conveyor for a fiber blending unit comprising a blending belt, by means of which fiber material dropped onto the blending belt from a bale opener can be transported away, and comprising two guide walls arranged laterally to the blending belt for guiding the fiber material on both sides of the blending belt.

The invention further relates to a fiber blending unit for opening, weighing, and/or blending fiber material, comprising at least one bale opener for pre-opening fiber bales, and comprising a fiber conveyor which includes a blending belt, by means of which fiber material dropped onto the blending belt from a bale opener can be transported away, and comprising two guide walls arranged laterally to the blending belt for guiding the fiber material on both sides of the blending belt.

BACKGROUND

Fiber blending units are utilized for manufacturing exact and intensive blends for the spinning mill and the nonwoven industry. The fibers which are blended are, for example, various chemical fibers, cotton, and/or various reclaimed waste fibers. These types of fiber blending units generally include multiple weighing tray feeders arranged one behind the other in the conveying direction of a blending belt. By means of these weighing tray feeders, fiber bales are pre-opened, the opened fibers are weighed in a weighing container, in particular a pan scale, and are dropped on a blending belt in order to be transported away. Due to the weighing container being mostly arranged in the center over the blending belt, a heaped cone forms, which results in high fiber accumulations in a short period of time in the case of multiple machines arranged one behind the other. In this case, inaccurate weighings can occur due to weighing containers not having been completely emptied and material densities being too high in the center, with disruptions in the material transport and in the opening of the downstream blending roller.

DE 10 2004 048 222 A1 describes a device for blending fiber components, for example, fiber flakes or tufts, in particular in spinning preparation, fibrous web manufacture, or the like, in which the fiber material to be metered can be feed into at least two weighing containers and, after weighing, the fiber material can be dropped from the at least two weighing containers onto a blending belt. The weighing containers are arranged one behind the other—as viewed in the belt running direction—above the blending belt. The position of at least one weighing container can be displaceably adjusted transversely to the longitudinal extension of the blending belt. This solution is very expensive and structurally complex. Moreover, heaped cones are not avoided, but rather merely positioned differently in the transverse direction of the blending belt.

The problem addressed by the present invention is therefore that of creating a fiber conveyor and a fiber blending unit of the type mentioned at the outset, by means of which heaped cones can be avoided and/or their height can be at least reduced.

SUMMARY OF THE INVENTION

The problem addressed by the invention is solved by the features of the invention as described and enabled herein.

Additional objects and advantages of the invention will be set forth in part in the following description, or may be obvious from the description, or may be learned through practice of the invention.

A fiber conveyor for a fiber blending unit is provided. The fiber conveyor comprises a blending belt including two guide walls. By means of the blending belt, fiber material dropped from a bale opener onto the blending belt can be transported away. The two guide walls are arranged laterally to the blending belt. Therefore, a first guide wall is arranged on a left side—in the conveying direction—of the blending belt, and a second guide wall is arranged on a right side—in the conveying direction—of the blending belt. Due to the guide walls, the fiber material is guided and/or held on both sides of the blending belt. The guide walls are preferably fixed in position. Therefore, the guide walls do not move with the blending belt. The fiber conveyor comprises at least one rotary distributor arranged over the blending belt. By means of the rotary distributor, the fiber material dropped onto the blending belt can be distributed between the two guide walls in the transverse direction of the blending belt by means of a rotational movement. As a result, heaped cones can be avoided and/or their height can be at least reduced. As a result, an interference-free operation of the fiber blending unit provided therefor can be ensured.

The blending belt is preferably a continuous transport belt which moves in a conveying direction in order to transport the fiber material. The fiber material is preferably dropped onto the blending belt in an non-homogeneously distributed manner. As a result, the fiber material is arranged, for example, on one side in the transverse direction of the blending belt, and therefore only one part of the blending belt is effectively utilized. The rotary distributor is preferably arranged over the blending belt in such a way that the fiber material can be homogeneously distributed onto the blending belt in the transverse direction of the blending belt. The rotary distributor rotates for this purpose. Continuously dropped fiber material is therefore transported in the direction of the rotary distributor via the blending belt. The fiber material non-homogeneously distributed in the transverse direction of the blending belt is captured by the rotary distributor and is distributed in the transverse direction of the blending belt, in particular homogeneously across the entire width of the blending belt. The capturing, moving, and re-dropping of the fiber material takes place automatically via the rotational movement of the rotary distributor. The fiber material drops from the rotary distributor essentially on its own. Preferably, the fiber material is displaced on the blending belt by the rotary distributor. The partially arranged fiber material is homogeneously distributed on the blending belt by the rotary distributor.

It is advantageous when an axis of rotation of the rotary distributor is aligned in the direction of the blending belt, as seen in a front view of the fiber conveyor. The axis of rotation of the rotary distributor is preferably aligned perpendicularly to the blending belt. The axis of rotation preferably extends upwards from the blending belt. The axis of rotation is preferably arranged in the center above the blending belt, in the transverse direction of the blending belt. Alternatively, the axis of rotation of the rotary distributor is preferably spaced apart from the center of the blending belt, in particular being offset from the center. It has been proven that the homogeneous distribution of the fiber material takes place in an easy way as a result.

Advantageously, the rotary distributor comprises at least one distributor element which can rotate about the axis of rotation and/or is radially spaced apart from the axis of rotation. The at least one distributor element therefore forms, during rotation, a hollow body of rotation, on the lateral surface of which the fiber material is picked up by the rotating distributor element. The fiber material therefore cannot penetrate the interior of the hollow body of rotation. Instead, the fiber material is picked up by the distributor element and distributed in the transverse direction of the blending belt.

The distributor element is preferably spaced apart from the guide walls, and therefore the rotary distributor can rotate freely about its axis of rotation. Moreover, the hollow body of rotation preferably has an identical or different transverse distance to the two guide walls. When the rotary distributor is driven, and therefore the distributor element rotates about the axis of rotation, the fiber material arranged on one side of the blending belt is carried along by the distributor element. Due to the rotation of the distributor element about the axis of rotation, the fiber material is carried along in the direction of rotation. As a result of the rotation or due to newly picked-up fiber material, the fiber material drops from the distributor element. The fiber material is preferably displaced on the blending belt in the direction of rotation by the distributor element.

It is advantageous when the hollow body of rotation extends essentially across the entire width of the blending belt. As a result, dropped fiber material can be captured by the rotary distributor across the entire width of the blending belt and, as a result, can be homogeneously distributed on the blending belt.

A vertical distance is advantageously formed in the vertical direction between the distributor element and the blending belt. The distributor element is therefore spaced apart from the blending belt. The vertical distance determines the fiber height at which the fiber material is leveled by the rotary distributor. The vertical distance varies preferably depending on the fibers to be blended. In the case of very fine fibers which, when collectively placed on the blending belt, have only a very low height, the vertical distance is preferably rather small. If the accumulation of the fiber material in the vertical direction on the blending belt is high, for example, due to coarse fibers, it is also appropriate to increase the vertical distance of the distributor element in order to protect the rotary distributor against overload.

It is advantageous when the distributor element has a free end on the blending-belt side. The free end is preferably oriented, as viewed in a top view, counter to a motor-powered direction of rotation of the rotary distributor. The rotary distributor is therefore driven in one of the two directions of rotation by a drive, in particular, an electric motor. The free end of the distributor element does not point in the direction of the rotational movement, but rather in the direction opposite thereto. As a result, fiber material is prevented from getting stuck on the free end and winding up on the distributor element. Instead, by way of the orientation of the free end counter to the direction of rotation, it is ensured that fiber material that has become stuck on the distributor element is wiped off of the free end.

The distributor element can preferably rotate about its own body axis, and therefore its free end can be aligned in the direction of the axis of rotation. When fiber material has become stuck on the distributor element, the fiber material can be wiped off in an easy way due to the rotation of the distributor element counter to the direction of rotation. Furthermore, the distributor element can comprise strings on its free end, which move radially outwardly as a result of the rotation of the rotary member.

The distributor element preferably includes an anchored end on its side opposite the free end. The distributor element initially extends essentially perpendicularly to the direction of rotation, preferably proceeding from the anchored end. The distributor element transitions into the free end, essentially in a C-shape, and therefore the free end is aligned counter to the direction of rotation.

Moreover, it is advantageous when the distributor element is constructed from a deformed rod and/or includes at least one sharp bend. The rod is preferably an elongate hollow or solid body and/or has a round profile. The rod preferably has the same thickness across its entire length. In order to change the running direction of the distributor element from the anchored end up to the free end, the distributor element includes at least one sharp bend. The sharp bend is preferably directed radially inwardly or outwardly. In this way, it is ensured that the fiber material is carried along in an optimal way. The term "sharp bend" is understood to mean a fold and/or bend which has a small radius and extends across only a small and/or essentially punctiform section of the distributor element.

It is advantageous when the distributor element is essentially L-shaped. The distributor element preferably comprises a first section, a second section, and/or a first sharp bend formed between the two sections. The first section extends preferably in the vertical direction. The first section extends in the direction of the blending belt, preferably proceeding from the anchored end of the distributor element. The second section extends preferably in the horizontal and/or circumferential direction of the rotary distributor. The second section extends preferably in parallel or obliquely to the surface of the blending belt. The shape of the distributor element makes it possible for the fiber material to be homogeneously distributed in the transverse direction, for the risk of the fiber material getting stuck on the distributor element to be reduced, and for caught fiber material to be wiped off again via the free end.

It is advantageous when the second section extends, proceeding from the first sharp bend, radially outwardly and counter to the motor-driven direction of rotation. It is further advantageous when the second section is curved, proceeding from the first sharp bend, radially inwardly as viewed in a top view. The second section preferably essentially describes, in a top view, a C-shape, a half-moon shape, or a circular shape. As a result, the second section gently engages into the fiber material in order to distribute the fiber material, without the fiber material getting stuck via the free end and/or skewered thereby. The second section can be aligned, in this case, obliquely upward or downward with respect to the blending belt. Alternatively, the second section can be arranged in parallel to the blending belt.

The first section advantageously includes a second sharp bend. In a top view, a lower sub-area of the first section is therefore sharply bent counter to the motor-driven direction of rotation of the rotary distributor. The first section extends in the direction of the lower sub-area, preferably proceeding from the upper sub-area of the anchored end of the distributor element.

It is advantageous when the distributor element tapers in an end section toward the free end. Alternatively, it is also conceivable, however, that the distributor element essentially has the same thickness across its entire length. The distributor element preferably tapers to a point. As a result, caught fibers can be easily wiped off of the distributor element. The end section of the distributor element is preferably arranged in parallel or obliquely to the blending belt. The end section is preferably formed in the area of the second section. When the rotary distributor rotates, the second section preferably impacts the fiber material first. The shape of the distributor element ensures that the fiber material can easily come loose from the distributor element and does not clog the rotary distributor.

The rotary distributor advantageously comprises a drive shaft and/or a support element. The drive shaft is arranged coaxial to the axis of rotation. The drive shaft is preferably driven by a motor, and therefore the drive shaft rotates. The drive shaft and the support element are preferably connected to each other, and therefore the support element rotates when the drive shaft is driven. The support element extends away from the drive shaft in the radial direction. The at least one distributor element is arranged in a radially outer area on the support element. The support element is preferably designed as a, in particular, circular support disk. The diameter of the support element is preferably individually adapted depending on the width of the blending belt. The wider the blending belt is, the greater the diameter of the support element also preferably is.

The fiber conveyor advantageously comprises a holder. The holder extends across the blending belt and/or is secured on the two guide walls. The rotary distributor is held over the blending belt by the holder. The holder preferably extends between the two side walls and is preferably connected thereto.

The vertical distance of the distributor element to the blending belt is advantageously adjustable in a ratcheted and/or stepless manner. Preferably, the vertical distance of the second section of the distributor element to the blending belt can be adjusted. The rotary distributor and/or the at least one distributor element are/is preferably height-adjustable with respect to the blending belt.

It is advantageous when the rotary distributor comprises multiple distributor elements. The distributor elements are spaced apart from each other in the circumferential direction of the rotary distributor. The rotary distributor comprises, in particular, six distributor elements. The number of distributor elements is preferably dependent on the width of the blending belt and/or the diameter of the support element of the rotary distributor. The wider the blending belt and/or the greater the diameter of the support element is, the greater the number of distributor elements on the rotary distributor also preferably is. The distributor elements are preferably identically designed. The support element preferably includes openings, through which the end of the particular distributor element opposite the free end can be inserted. The distributor element is connected, in particular detachably, to the support element, and therefore its end opposite the free end is anchored on the support element. Due to the distributor elements arranged in the circumferential direction, a circle is essentially formed, wherein the individual distributor elements are preferably arranged so as to be spaced apart from each other. The end sections of the distributor elements are each spaced apart from the facing second section of the adjacent distributor element. Alternatively, the end sections of the distributor elements are connected to each other, and therefore these end sections essentially form a closed circle or a polygon. In this way, an efficient distribution of the fiber material on the blending belt is ensured.

The rotational speed at which the rotary distributor is set into rotation by the drive is preferably dependent on the number of distributor elements on the rotary distributor. The more distributor elements there are arranged on the rotary distributor, the lower the speed preferably is. If the rotary distributor comprises a few distributor elements, the speed is preferably higher as compared to the design comprising multiple distributor elements. When the rotary distributor comprises several distributor elements, however, the speed is also lower as compared to the design comprising fewer distributor elements.

Moreover, it is advantageous when the rotary distributor is adjustable with respect to the holder in the transverse direction and/or the longitudinal direction of the blending belt and/or in the vertical direction. The holder preferably comprises at least one guide rail which extends preferably in parallel and/or obliquely to the longitudinal direction of the blending belt. The rotary distributor is preferably displaceable along the guide rail. Furthermore, it is possible that the holder and/or the rotary distributor are/is displaceable along the transverse axis. In this case, the holder preferably comprises a transverse rail which is arranged transversely to the longitudinal direction of the blending belt. In order to change the vertical distance of the distributor elements with respect to the blending belt, the rotary distributor can preferably be lowered or raised with respect to the holder.

The fiber conveyor advantageously comprises multiple rotary distributors arranged one behind the other in the longitudinal direction of the blending belt. Preferably, fibers from multiple bale openers are transported and blended on the blending belt. For each bale opener, the fiber conveyor preferably comprises at least one downstream rotary distributor, so that the fibers are continuously distributed on the blending belt along the entire fiber conveyor.

Furthermore, a fiber blending unit for opening, weighing, and/or blending fiber material is provided. The fiber blending unit comprises a bale opener and a fiber conveyor. The bale opener is designed for pre-opening the fiber bales. The fiber conveyor comprises a blending belt including two guide walls. By means of the blending belt, fiber material dropped from the bale opener onto the blending belt can be transported away. The guide walls are arranged laterally to the blending belt, and therefore the fiber material is guided on both sides of the blending belt. The fiber conveyor is designed according to the preceding description, wherein the mentioned features can be present individually or in combination. The fiber conveyor comprises a rotary distributor arranged over the blending belt. The rotary distributor is designed for homogeneously distributing, on the blending belt, fiber material conveyed on the blending belt. The rotary distributor is preferably designed similarly to a whisk. As a result, heaped cones on the blending belt can be avoided and/or their height can be at least reduced. As a result, an interference-free operation of the fiber blending unit can be ensured.

It is advantageous when the bale opener is designed as a weighing tray feeder and/or a pan scale for weighing and dropping the fiber material. The fiber bales opened by the bale opener are conveyed upwardly by a conveyor. From there, the fibers drop into the pan scale and, once a certain weight as been reached, are dropped onto the blending belt.

BRIEF DESCRIPTION OF THE DRAWINGS

Further advantages of the invention are described in the following exemplary embodiments. Wherein.

DETAILED DESCRIPTION

Figure 1:
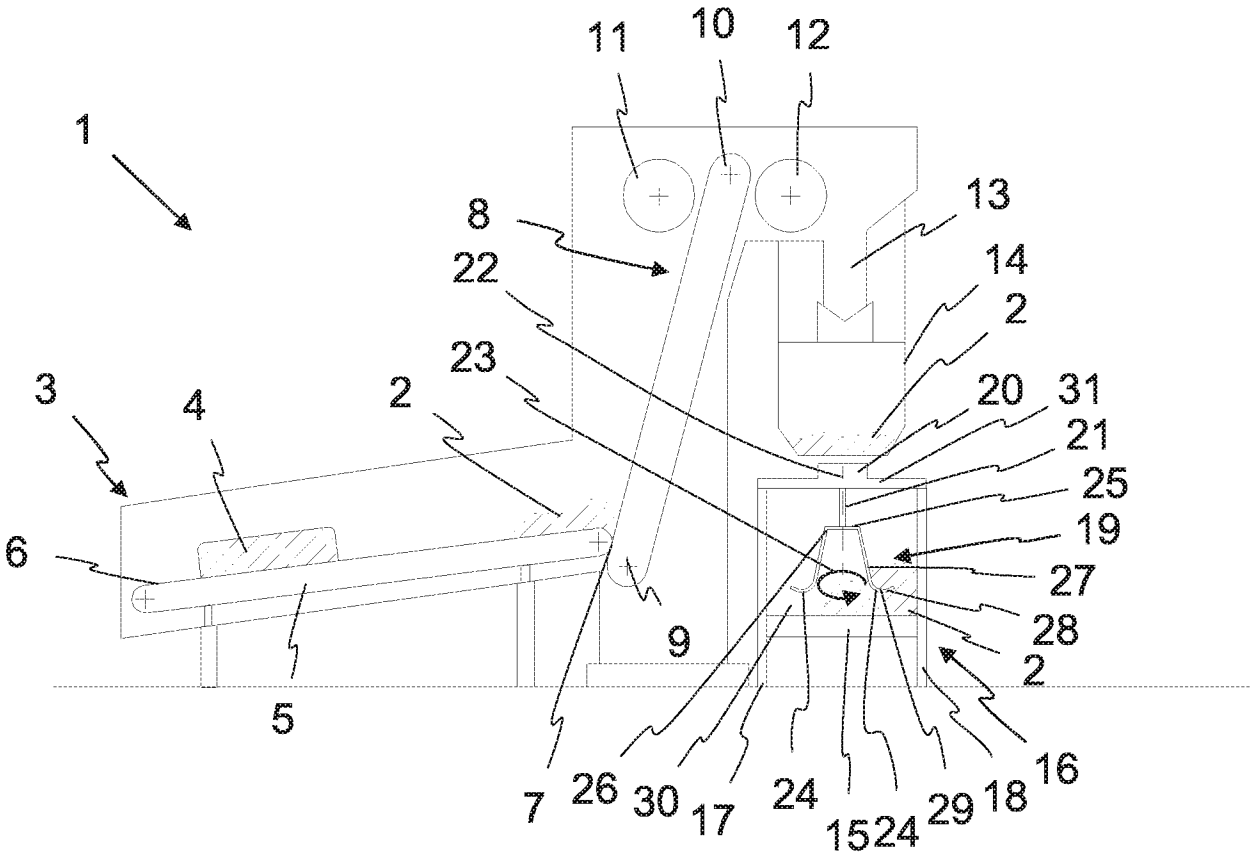
FIG. 1 shows a fiber blending unit comprising a fiber conveyor represented in a front view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a fiber blending unit 1 for opening, weighing, and/or blending fiber material 2. The fiber blending unit 1 comprises a bale opener 3 for pre-opening fiber bales 4. The bale opener 3 comprises a conveyor table 5 which is equipped with a continuous conveyor belt 6, which can be driven in a conveying direction, for fiber bales 4. At a deflecting edge 7 of the continuous conveyor belt 6, the fiber bales 4 break off and are transported obliquely upward by a fiber material milling belt 8. The fiber material milling belt 8 is preferably a needle slat belt which is driven in the usual way and runs over a lower and an upper deflecting roller 9, 10. The fiber material milling belt 8 mills fiber material 2 off of the fiber bale 4, wherein excess fiber material 2 is conveyed back downward by means of a re-stripping roller 11. The fiber material 2 is stripped off in the area of the upper deflection roller 10 by a doffing roller 12. The fiber material 2 is dropped from the doffing roller 12 through a material chute 13 into a pan scale 14. When a target amount has been registered in the pan scale 14 by means of an appropriate weighing of the material weight, the pan scale 14 is opened and the pre-opened fiber material 2 located therein is dropped onto an underlying blending belt 15. The fiber blending unit 1 can comprise multiple bale openers 3 arranged one behind the other in the longitudinal direction of the blending belt 15.

In addition to the at least one bale opener 3, the fiber blending unit according to FIG. 1 therefore also comprises a fiber conveyor 16 which includes the blending belt 15. The blending belt 15 transports away the fiber material 2 which has been dropped from the at least one bale opener 3 onto the blending belt 15. Two guide walls 17, 18 are arranged laterally to the blending belt 15 for guiding the fiber material 2 on both sides of the blending belt 15.

The fiber conveyor 16 comprises at least one rotary distributor 19 arranged above the blending belt 15. By means of the rotary distributor 19, the fiber material 2 dropped onto the blending belt 15 can be homogeneously distributed in the transverse direction of the blending belt 15 by means of a rotational movement. The rotational movement is generated by a drive 20 which drives a drive shaft 21. The drive 20 can be an electric motor, for example. The drive shaft 21 rotates, being powered by a motor, about an axis of rotation 22 in a direction of rotation 23. The axis of rotation 22 is aligned perpendicularly to the blending belt 15 as seen in a front view. Due to a corresponding arrangement, the effective range of the rotary distributor 19 is essentially parallel to the blending belt 15 and perpendicular to the axis of rotation 22. The effective range of the rotary distributor 19 is defined essentially by at least one distributor element 24 when said distributor element rotates.

According to the present exemplary embodiment, the rotary distributor 19 comprises multiple distributor elements 24 for distributing the fiber material 2. The distributor elements 24 rotate jointly about the axis of rotation 22 when the drive shaft 21 is driven. The distributor elements 24 are arranged on a support element 25 of the drive shaft 21 which transmits the rotational movement to the distributor elements 24. The distributor elements 24 are arranged in a radially outer area of the support element 25. The support element 25 is preferably a circular plate, on the circumference of which the distributor elements 24 are connected to said plate. The distributor elements 24 are screwed or welded to the support element 25. In the connection area with the support element 25, the individual distributor elements 24 each comprise an anchored end 26, in which said distributor elements are fixedly and/or detachably connected to the support element 25.

The distributor elements 24 are each essentially constructed as a deformed rod. The individual distributor elements 24 are each subdivided, proceeding from their anchored end 26, essentially into a first and a second section 27, 28. Due to the two sections 27, 28, the distributor elements 24 are essentially L-shaped. The first section 27 extends, proceeding from the anchored end 26, essentially vertically or slightly obliquely downward in the direction of the blending belt 15.

Figure 3:
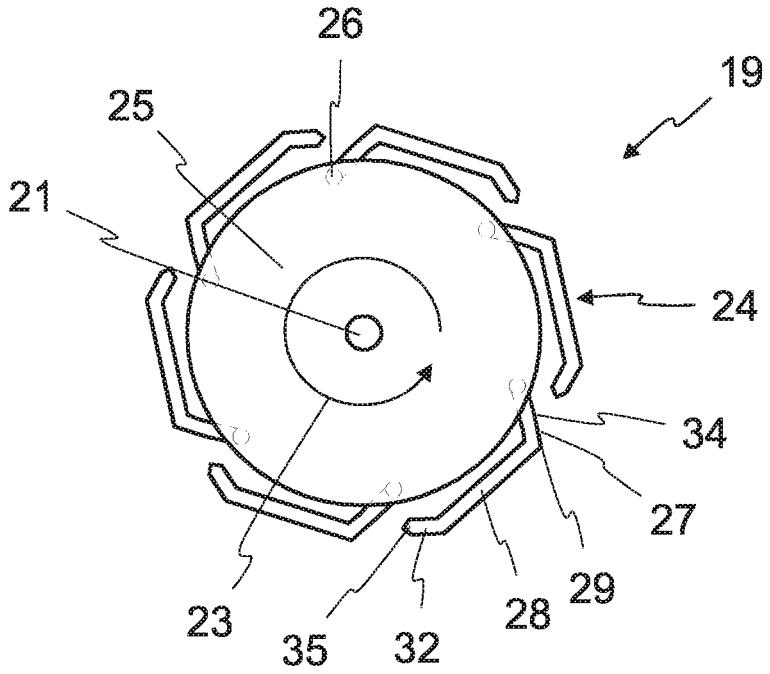
FIG. 3 shows a top view of a rotary distributor of the fiber conveyor.

The first section 27 transitions via a first sharp bend 29 into the second section 28 (cf. FIG. 3). The second section 28 extends in the horizontal direction of the rotary distributor 19 and, therefore, essentially in parallel or slightly obliquely to the blending belt 15. The second section 28 forms, in particular, the short side of the letter "L". With regard to the shape of the distributor element 24, reference is made to the further figures, since the two sections are more apparent therein. The second section 28 is preferably spaced apart from the blending belt 15 in the vertical direction via a vertical distance 30.

When the rotary distributor 19 is rotated, the distributor elements 24 preferably rotate in the counterclockwise direction, whereby the direction of rotation 23 is specified. The second section 28 of the distributor element 24 takes up fiber material 2 due to its radially inwardly curved shape and homogeneously distributes said fiber material on the blending belt 15 (cf. FIG. 2).

The rotary distributor 19 comprises a holder 31, by means of which said rotary distributor is held above the blending belt 15. The holder 31 rests on the two guide walls 17, 18 of the blending belt 15. The vertical distance 30 between the distributor elements 24 and the blending belt 15 can be adjusted preferably via the holder 31.

Figure 2:
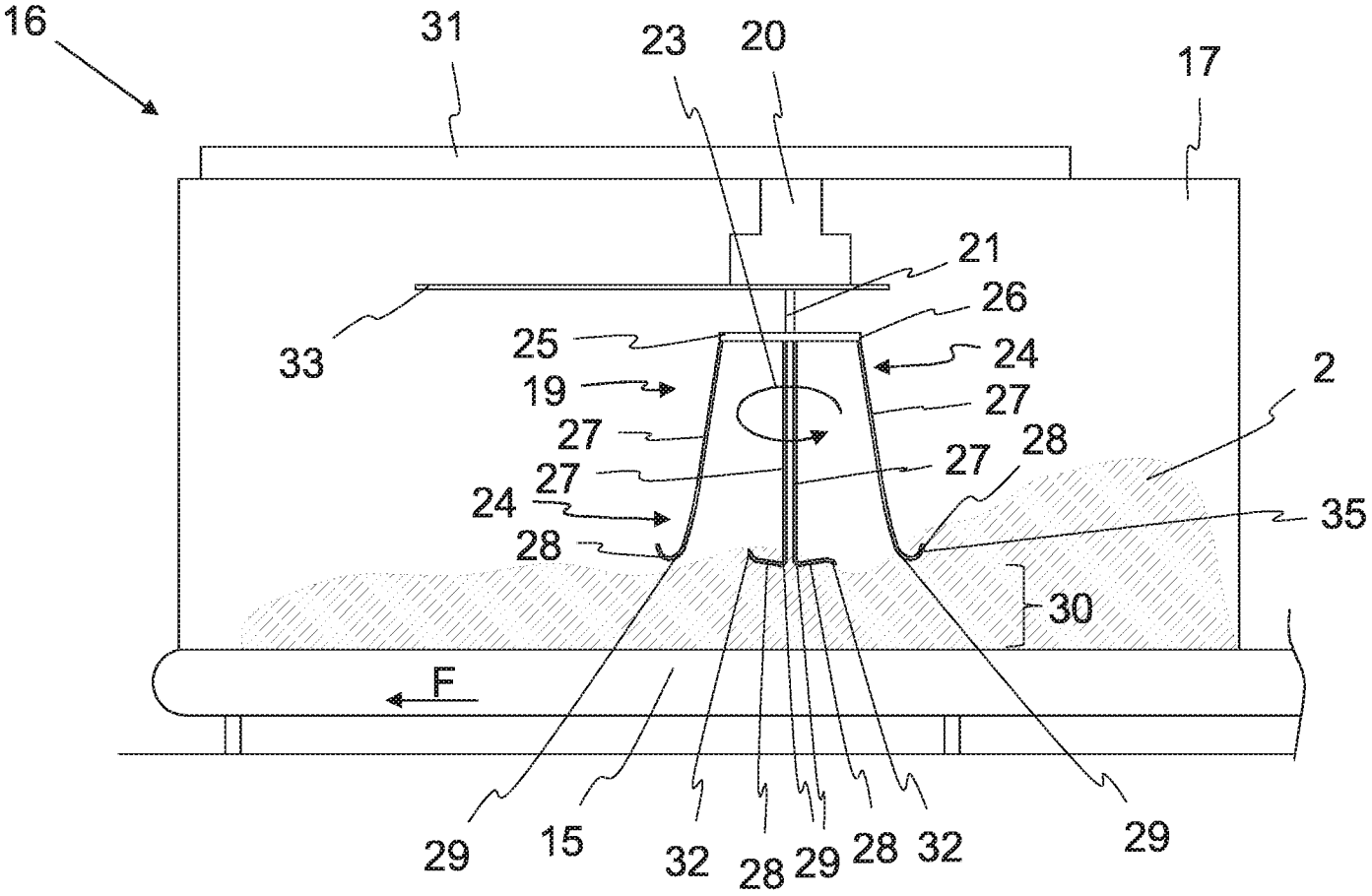
FIG. 2 shows a detailed view of the fiber conveyor in a side view.

FIG. 2 shows a side view of the fiber conveyor 16 according to FIG. 1. The individual distributor elements 24 extend in the direction of the blending belt 15, proceeding from the support element 25, wherein said distributor elements are spaced apart from the blending belt 15 via the vertical distance 30. The first section 27 extends essentially straight or slightly obliquely with respect to the vertical axis and/or the axis of rotation 22. The second section 28 extends essentially in parallel or slightly obliquely to the transverse direction of the blending belt 15. The second section 28 is slightly curved, and therefore said section extends, proceeding from the first sharp bend 29, counter to the direction of rotation 23 which runs in the counterclockwise direction. The second section 28 is aligned essentially in the clockwise direction. When the drive shaft 21 is driven, the second sections 28 of each of the distributor elements 24 encounter the fiber material 2. The fiber material 2 is pushed essentially into the sheet plane, as represented in FIG. 2, whereby said fiber material is homogeneously distributed on the blending belt 15.

As is apparent in FIG. 3, in particular, the distributor elements 24 each comprise an end section 32 on their free end 35. The end section 32 essentially tapers, and therefore the free end 35 is pointed.

The rotary distributor 19 can be displaced in the longitudinal direction of the blending belt 15. For this purpose, the fiber conveyor 16 according to FIG. 2 comprises a guide rail 33.

The number of distributor elements 24 on the rotary distributor 19 can vary depending on the application. Preferably, the rotary distributor 19 comprises one, two, four, six, or eight distributor elements 24. The length of the first sections 27 remains the same, preferably independently of the number of distributor elements 24. In contrast, the length of the second sections 28 of the distributor elements 24 can change. The fewer distributor elements 24 the rotary distributor 19 has, the longer the second sections 28 can be. However, if multiple distributor elements 24 are formed on the rotary distributor 19, it can be helpful to slightly shorten the second sections 28, so that said sections are spaced apart from each other. The end sections 32 of the distributor elements 24 are each spaced apart from the first section 27 of the adjacent distributor element 24.

FIG. 3 shows a top view of one exemplary embodiment of the rotary distributor 19. The rotary distributor 19 comprises six distributor elements 24 spaced apart from each other in the circumferential direction. The distributor elements 24 each extend from the anchored end 26 in the direction of the free end 35, in particular of the end section 32. The first section 27 extends slightly obliquely downward to the first sharp bend 29. Proceeding from the first sharp bend 29, the second section 28 extends essentially in the clockwise direction and/or counter to the specified direction of rotation 23. The second section 28 extends tangentially to the axis of rotation 21, as represented in the figure. Alternatively, said section could also extend, proceeding from the first sharp bend 29, radially outwardly in the direction of the free end 35 and/or could be curved radially inwardly toward the axis of rotation. The end section 32 of the second section 28 tapers in the direction of the free end 35.

The first section 27 comprises a second sharp bend 34, and therefore a lower subarea of the first section 27 is rotated counter to the direction of rotation 23. The two sections 27, 28 therefore both extend essentially counter to the motor-powered direction of rotation 23 of the drive shaft 21.

The present invention is not limited to the exemplary embodiments which have been represented and described. Modifications within the scope of the claims are also possible, as is any combination of the features, even if they are represented and described in different exemplary embodiments.

REFERENCE CHARACTERS

1 fiber blending unit
2 fiber material
3 bale opener
4 fiber bale
5 conveyor table
6 continuous conveyor belt
7 deflecting edge
8 fiber material milling belt
9 lower deflecting roller
10 upper deflecting roller
11 re-stripping roller
12 doffing roller
13 material chute
14 pan scale
15 blending belt
16 fiber conveyor
17 first guide wall
18 second guide wall
19 rotary distributor
20 drive
21 drive shaft
22 axis of rotation
23 direction of rotation
24 distributor element
25 support element
26 anchored end
27 first section
28 second section
29 first sharp bend
30 vertical distance
31 holder
32 end section
333 guide rail
34 second sharp bend
35 free end
F conveying direction

The invention claimed is:

1. A fiber conveyor for a fiber blending unit, comprising:

a blending belt, wherein fiber material dropped onto the blending belt from a bale opener is transportable away by the blending belt;

opposite guide walls arranged laterally to the blending belt to guide the fiber material on both sides of the blending belt;

a rotary distributor arranged above the blending belt so that the fiber material dropped onto the blending belt is distributable in a transverse direction of the blending belt between the two guide walls by rotational movement of the rotary distributor;

wherein the rotary distributor comprises at least one distributor element radially spaced from and rotatable about an axis of rotation; and wherein the distributor element comprises an L-shape with a first section extending in a vertical direction, a second section extending in a horizontal direction corresponding to a circumferential direction of rotation of the rotary distributor, and a first bend between the first and second sections.

2. The fiber conveyor as in claim 1, wherein, as seen in a top view, the second section extends from the first bend radially outwardly or radially inwardly and counter to the direction of rotation of the rotary distributor.

3. The fiber conveyor as in claim 1, wherein, as seen in a top view, the first section comprises a second bend, wherein a lower sub-area of the first section is bent counter to the direction of rotation of the rotary distributor.

4. The fiber conveyor as in claim 1, further comprising a drive shaft configured with the rotary distributor coaxial to an axis of rotation of the rotary distributor, and a support element extending radially away from said drive shaft, the distributor element arranged on a radially outer area of the support element.

5. The fiber conveyor as in claim 1, further comprising a holder extending across the blending belt between the two guide walls, the rotary distributor supported by the holder above the blending belt.

6. The fiber conveyor as in claim 5, wherein the rotary distributor is displaceable with respect to the holder in one or more of a transverse direction relative to the blending belt, a longitudinal direction of the blending belt, or a vertical direction relative to the blending belt.

7. The fiber conveyor as in claim 1, wherein the rotary distributor comprises a plurality of distributor elements spaced apart from each other along a circumferential direction of the rotary distributor.

8. A fiber conveyor for a fiber blending unit, comprising:

a blending belt, wherein fiber material dropped onto the blending belt from a bale opener is transportable away by the blending belt;

opposite guide walls arranged laterally to the blending belt to guide the fiber material on both sides of the blending belt;

a rotary distributor arranged above the blending belt so that the fiber material dropped onto the blending belt is distributable in a transverse direction of the blending belt between the two guide walls by rotational movement of the rotary distributor; and further comprising a plurality of the rotary distributors arranged one behind the other in the longitudinal direction of the blending belt.

* * * * *